US010551796B2

(12) United States Patent
Modaragamage

(10) Patent No.: US 10,551,796 B2
(45) **Date of Patent: *Feb. 4, 2020**

(54) ELECTRONIC WATCH CLASP SYSTEMS AND METHODS

(71) Applicant: Wearatec, LLC, Barrie (CA)

(72) Inventor: Dilshan Thilina Modaragamage, Barrie (CA)

(73) Assignee: WEARATEC LLC, Barrie (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/218,685

(22) Filed: Jul. 25, 2016

(65) Prior Publication Data

US 2016/0334759 A1 Nov. 17, 2016

Related U.S. Application Data

(63) Continuation of application No. 14/842,486, filed on Sep. 1, 2015, now Pat. No. 9,551,978, which is a (Continued)

(51) Int. Cl.
*A44C 5/24* (2006.01)
*G04B 37/14* (2006.01)

(Continued)

(52) U.S. Cl.
CPC ..... *G04B 47/063* (2013.01); *A44C 5/147* (2013.01); *A44C 5/22* (2013.01); *A44C 5/24* (2013.01);

(Continued)

(58) Field of Classification Search
CPC .... A44C 5/14; A44C 5/22; A44C 5/24; A44C 5/147; G04C 3/00; G04B 19/04; G04B 37/0058; G04B 47/063; G04B 99/00; G04B 37/1486; G04G 17/00; G04G 9/00; G04G 21/08; G04G 17/045; G04G 21/025; G04G 21/04; G04R 20/00
See application file for complete search history.

(56) References Cited

U.S. PATENT DOCUMENTS 1,778,044 A 10/1930 Speidel et al.
2,518,551 A 8/1950 Jaccarino (Continued)

FOREIGN PATENT DOCUMENTS

CA 2847645 A1 6/2014
CH 645525 A5 10/1984

(Continued)

OTHER PUBLICATIONS

Supplemental European Search Report of the European Patent Office, Issued in European Application No. 15811501.4-1731; dated Mar. 24, 2017; 7 pages.

(Continued)

*Primary Examiner* — Sean P Kayes
(74) *Attorney, Agent, or Firm* — Ulmer & Berne LLP

(57) ABSTRACT

Embodiments of a watch can include a watch having an analog watch face, a first watch band portion, and a second watch band portion, where the watch can include a digital clasp having a digital display and a circuit board associated with a controller.

20 Claims, 4 Drawing Sheets

Related U.S. Application Data continuation of application No. 14/560,137, filed on Dec. 4, 2014, now Pat. No. 9,152,129.

(60) Provisional application No. 62/016,878, filed on Jun. 25, 2014.

(51) Int. Cl.

| | |
|---|---|
| ***A44C 5/22*** | (2006.01) |
| ***G04B 47/06*** | (2006.01) |
| ***G04G 17/00*** | (2013.01) |
| ***G04B 99/00*** | (2006.01) |
| ***G04G 9/00*** | (2006.01) |
| ***G04G 21/08*** | (2010.01) |
| ***G04R 20/00*** | (2013.01) |
| ***G04G 17/04*** | (2006.01) |
| ***G04G 21/02*** | (2010.01) |
| ***G04G 21/04*** | (2013.01) |
| ***A44C 5/14*** | (2006.01) |
| *G04C 3/00* | (2006.01) |

(52) U.S. Cl.

CPC ..... *G04B 37/1486* (2013.01); *G04B 99/00* (2013.01); *G04G 9/00* (2013.01); *G04G 17/00* (2013.01); *G04G 17/045* (2013.01); *G04G 21/025* (2013.01); *G04G 21/04* (2013.01); *G04G 21/08* (2013.01); *G04R 20/00* (2013.01); *G04C 3/00* (2013.01)

(56) References Cited

U.S. PATENT DOCUMENTS

| | | | | |
|---|---|---|---|---|
| 3,293,846 | A | 12/1966 | Pauli | |
| 3,585,744 | A | 6/1971 | Amone | |
| 3,677,449 | A | 7/1972 | Williams | |
| 4,444,513 | A | 4/1984 | Proellochs et al. | |
| 4,488,818 | A | 12/1984 | Saurer | |
| 4,748,604 | A | 5/1988 | Lambert | |
| 5,197,046 | A | 3/1993 | Siu | |
| 5,479,381 | A | 12/1995 | Goldenberg et al. | |
| 5,892,455 | A * | 4/1999 | Matsumoto | G09F 23/16 340/7.55 |
| 6,505,763 | B2 * | 1/2003 | Rota | A44C 5/24 224/174 |
| 6,587,083 | B1 | 7/2003 | Basturk | |
| 6,671,231 | B2 | 12/2003 | Gilomen | |
| 6,779,917 | B1 | 8/2004 | Chappuis | |
| 6,903,784 | B1 * | 6/2005 | Basturk | G04G 9/0082 349/2 |
| 6,944,098 | B2 | 9/2005 | Rochat et al. | |
| 7,251,197 | B2 * | 7/2007 | Yoshida | H04B 1/385 368/10 |
| 7,433,274 | B1 | 10/2008 | Bath | |
| 7,529,155 | B2 | 5/2009 | Fasciano | |
| 7,575,368 | B2 | 8/2009 | Guillaume | |
| 7,618,260 | B2 | 11/2009 | Daniel et al. | |
| 7,755,977 | B2 * | 7/2010 | Furetta | G04G 9/0035 349/56 |
| 8,301,211 | B2 * | 10/2012 | Lee | H04M 1/274525 340/539.11 |
| 8,576,073 | B2 * | 11/2013 | Mooring | G06F 1/163 340/407.1 |
| 8,725,842 | B1 | 5/2014 | Al-Nasser | |
| 2005/0276164 | A1 | 12/2005 | Amron | |
| 2006/0067167 | A1 * | 3/2006 | Garay | G04C 17/0091 368/67 |
| 2006/0109188 | A1 * | 5/2006 | Ikeda | H01Q 1/243 343/718 |
| 2006/0272134 | A1 * | 12/2006 | Turuani | A44C 5/24 24/71 J |
| 2007/0271740 | A1 * | 11/2007 | Yamamoto | A44C 5/246 24/265 WS |
| 2010/0128570 | A1 | 5/2010 | Smith et al. | |
| 2011/0182151 | A1 | 7/2011 | Geyer et al. | |
| 2011/0205851 | A1 | 8/2011 | Harris | |
| 2013/0083634 | A1 | 4/2013 | Hembo et al. | |
| 2013/0223195 | A1 | 8/2013 | Loetscher | |
| 2013/0271495 | A1 | 10/2013 | Nguyen et al. | |
| 2014/0127996 | A1 | 5/2014 | Park et al. | |
| 2014/0269217 | A1 | 9/2014 | Jenwatanavet et al. | |
| 2015/0049591 | A1 * | 2/2015 | Adams | G04G 21/08 368/13 |
| 2016/0029778 | A1 | 2/2016 | Fitzgerald et al. | |

FOREIGN PATENT DOCUMENTS

| | | | |
|---|---|---|---|
| DE | 3435207 | A1 | 4/1986 |
| DE | 202005004506 | U1 | 7/2006 |
| FR | 54478 | E2 | 5/1950 |
| JP | 2002040175 | A | 2/2002 |
| JP | 2002360317 | A | 12/2002 |
| JP | 2003325209 | A | 11/2003 |
| JP | 2011115365 | A | 6/2011 |

OTHER PUBLICATIONS

Substantially | Definition of Substantially by Merriam-Webster, Merriam-Webster.com, http://www.merriam-webster.com/dictionary/substantially (retrieved Jan. 22, 2017); 1 page.

International Search Report, issued in International Application No. PCT/US2015/037776; dated Oct. 13, 2015, 2 pages in its entirety.

Written Opinion of the International Searching Authority, issued in International Application No. PCT/US2015/037776; dated Oct. 13, 2015, 4 pages in its entirety.

* cited by examiner

ELECTRONIC WATCH CLASP SYSTEMS AND METHODS

REFERENCE TO RELATED APPLICATION

This application is a continuation of U.S. Non-Provisional Ser. No. 14/842,486, filed Sep. 1, 2015, which is a continuation of U.S. Non-Provisional application Ser. No. 14/560,137, filed Dec. 4, 2014, now U.S. Pat. No. 9,152,129, which claims priority to U.S. Provisional Patent Application No. 62/016,878, filed Jun. 25, 2014, which are hereby incorporated herein by reference in their entirety.

TECHNICAL FIELD

Embodiments of the technology relate, in general, to watch technology, and in particular to electronic, digital, and touchscreen watch clasps that can interface with a peripheral device.

BACKGROUND

Thanks to the recent advances in wireless communication technology, cellular telephones enjoy enormous popularity. While early models were large and heavy, and therefore difficult for a user to carry comfortably, newer models have steadily decreased in size and weight. The cellular telephones which are in use today are compact enough to fit a person's pocket or purse.

While the new models enjoy increased portability, they do suffer from several drawbacks. For instance, their light weight and small size renders the telephones prone to falling, breaking, or simply being forgotten. Additionally, when a cellular telephone user receives a call, a time loss is experienced while the user locates and retrieves the telephone (which may be in her pocket, purse, brief case, etc.).

In order to overcome these drawbacks, cellular telephones which can be worn on the wrist of a user have also been developed. In these systems a telephone device is in the form of a wristwatch fastened to the user's wrist via a strap, where a cellular phone mechanism replaces that of a watch in its conventional location.

BRIEF DESCRIPTION OF THE DRAWINGS

The present disclosure will be more readily understood from a detailed description of some example embodiments taken in conjunction with the following figures.

SUMMARY

Figure 1:
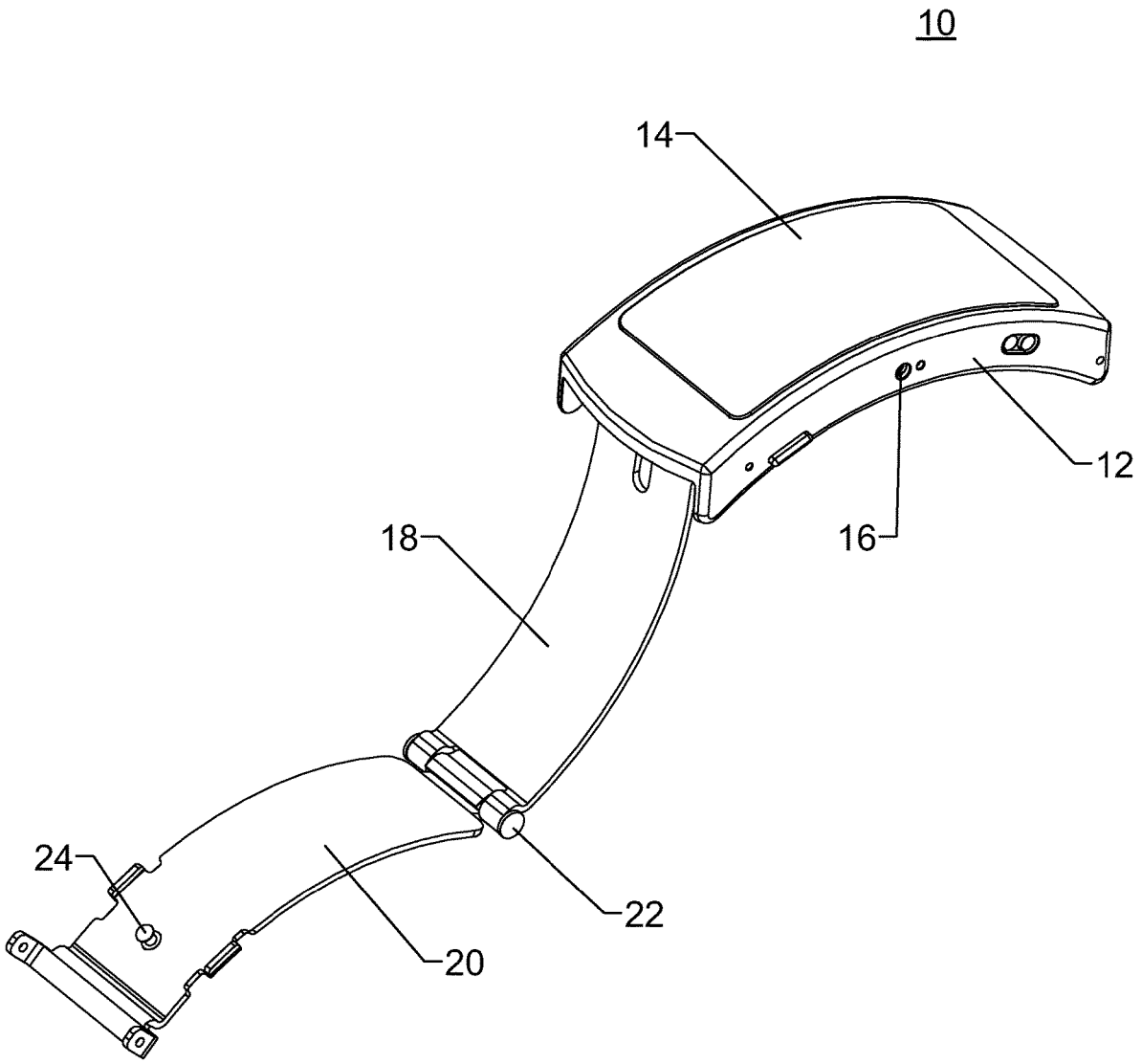
FIG. 1 depicts a perspective view of an electronic clasp according to one embodiment.

Embodiments of a watch include an analog watch face, a first watch band portion having a first end and a second end, where the first end of the first watch band portion is coupled with the analog watch face, a second watch band portion having a first end and a second end, wherein the first end of the second watch band portion is coupled with the analog watch face, a clasp housing, the clasp housing having an inner surface, an outer surface, a first end, and a second end, the inner surface of the clasp housing being curved to accommodate the anterior surface of a user's wrist, where the clasp housing includes a latch assembly configured for attachment to the second end of the first band portion and the second end of the second band portion, a digital display, where the digital display is at least partially retained by the clasp housing, and a circuit board associated with a controller, the circuit board and controller being coupled with the digital display, where the circuit board is at least partially retained by the clasp housing.

Embodiments include a watch including an analog watch face, a first watch band portion having a first end and a second end, where the first end of the first watch band portion is coupled with the analog watch face, a second watch band portion having a first end and a second end, where the first end of the second watch band portion is coupled with the analog watch face, a clasp housing, the clasp housing having an inner surface, an outer surface, a first end, and a second end, the inner surface of the clasp housing being curved to accommodate the anterior surface of a user's wrist, where the clasp housing includes a latch assembly configured for attachment to the second end of the first band portion and the second end of the second band portion, a first clasp arm, the first clasp arm having a first end and a second end, where the first end of the first clasp arm is coupled with the second end of the clasp housing such that the first clasp arm is configured to pivot relative to the clasp housing, a second clasp arm, the second clasp arm having a first end and a second end, the second clasp arm having a locking pin configured to engage the latch assembly when the digital clasp is in a closed position, where the second end of the second clasp arm is configured for attachment to the second end of the first band portion, a pivot, where the pivot couples the second end of the first clasp arm and the first end of the second clasp arm such that the first clasp arm is configured to pivot relative to the second clasp arm, a digital display, where the digital display is at least partially retained by the clasp housing, and a circuit board associated with a controller, the circuit board and controller being coupled with the digital display, where the circuit board is at least partially retained by the clasp housing.

DETAILED DESCRIPTION

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Described herein are example embodiments of apparatuses, systems, and methods for providing a wristwatch with an electronic, digital, or electromechanical clasp such that it can interface directly with a peripheral device, such as a smart phone. In one example embodiment, an electronic clasp can include a digital interface that can replace the existing clasp on a traditional wristwatch. In some embodiments, the electronic clasp can include any suitable digital feature such that the user gets the benefit of a traditional watch style, but with added digital functionality. In some embodiments, the electronic clasp can interface or otherwise communicate with a plurality of peripheral devices such as smartphones, tablets, computers, vehicles, other wearable devices, or the like.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Example embodiments described herein can allow a user to keep using a watch they enjoy, such as a high-end ROLEX, TAG HEUER, PATEK PHILLIPE, or PIAGE, without sacrificing the functionality that can come with a digital smart watch. For example, an electronic clasp can include any suitable interface, communication features, display, or digital features to add the features of a smart watch into an analog or standard watch. Additionally, or alternatively, the electronic clasp can be masked or otherwise designed to provide such benefits without detracting from the style of the standard watch.

An electronic clasp computer system in accordance with the present disclosure can be accessed via any suitable technique, such as a web-browser such as SAFARI, OPERA, GOOGLE CHROME, INTERNET EXPLORER, or the like executing on a client device. In some embodiments, the systems and methods described herein can be a web-based application or a stand-alone executable. Additionally, in some embodiments, the systems and methods described herein can integrate with various types of location-based systems, such as GPS, geo-fencing applications, and the like. Any suitable client device can be used to access, or execute, the electronic clasp computer system, such as laptop computers, desktop computers, smart phones, tablet computers, gaming system, and the like.

Systems and methods described herein may generally provide a digital, interactive environment for users (e.g., a touch sensitive interface) to complement the style of a standard or analog wristwatch. Interaction with the electronic clasp computer system may include, without limitation, keyboard entry, writing from pen, stylus, finger, or the like, with a computer mouse, or other forms of input (voice recognition, etc.). The interactive wristwatch retrofit computer system may be presented on a tablet, desktop, phone, board, or paper. In one embodiment, the user may interact with a digital interface by writing with a smart pen on normal paper, modified paper, or a hard flat surface of their preference. In this embodiment, the user may receive real-time feedback, or at least near real-time feedback, or may synchronize with electronic clasp computer system at a later date. The electronic clasp computer system can include a personal computer, one or multiple computers in a server-type system.

Figure 3:
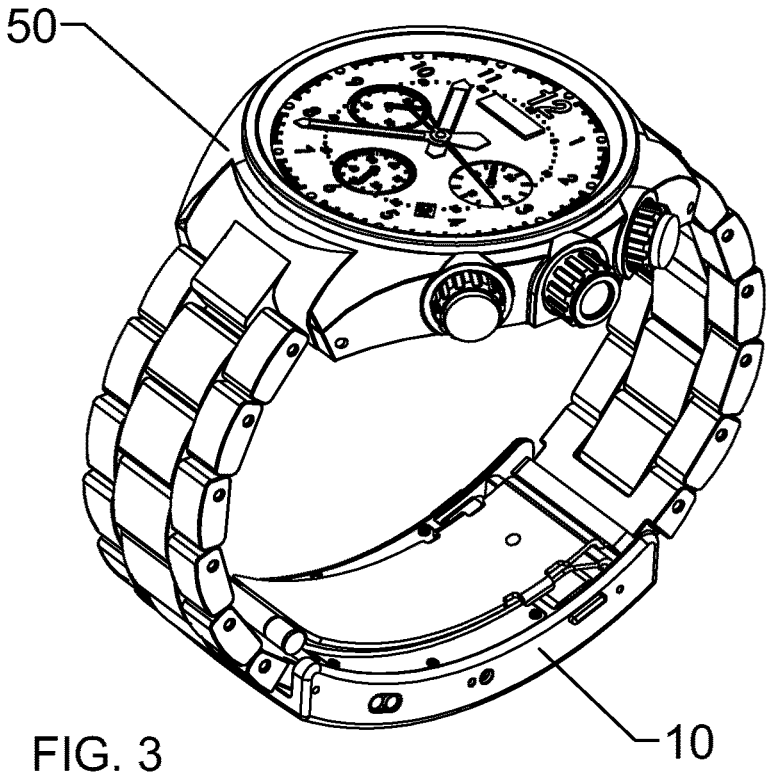
FIG. 3 depicts a top perspective view of a standard watch shown associated with the electronic clasp shown in FIG. 1.
Figure 4:
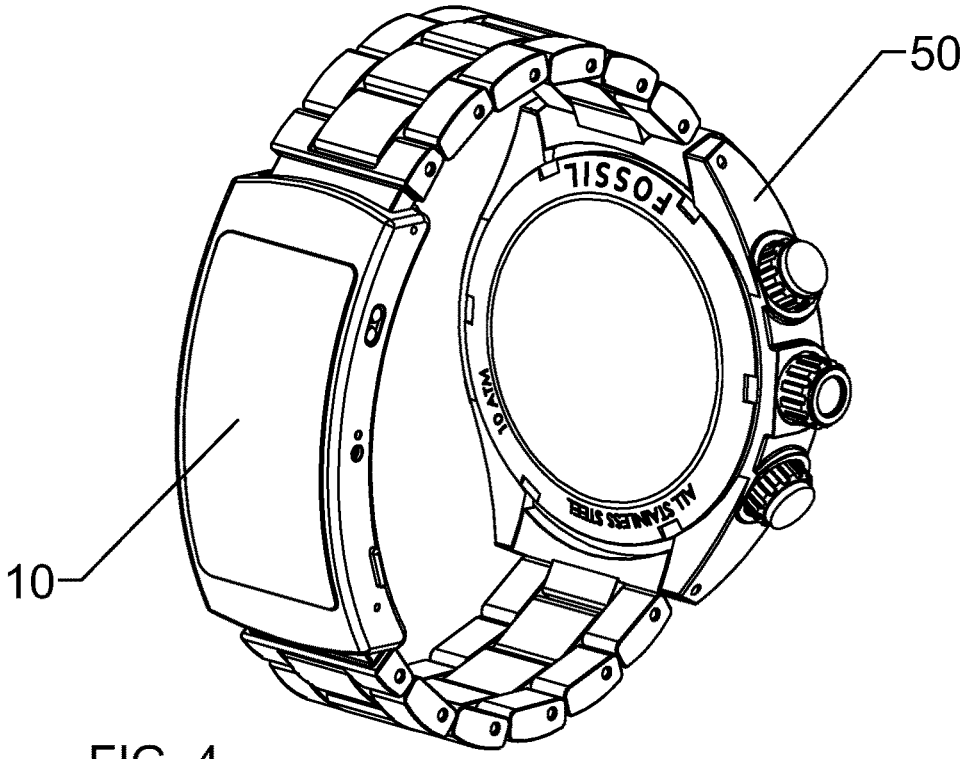
FIG. 4 depicts a bottom perspective view of the standard watch and electronic clasp shown in FIG. 3.

Referring now to FIG. 1, a perspective view of an electronic clasp 10 is shown in an open position according to one embodiment. The electronic clasp 10 can include a housing 12 that can retain a display 14. The display 14 can include a digital display, a touch screen display, or any other suitable interface. The housing 12 can retain a microphone 16 or any other suitable feature or component that can be associated with the display 14. The housing 12 can be pivotally coupled with a first clasp arm 18 and a second clasp arm 20, where the first clasp arm 18 can move relative to the second clasp arm 20 about a pivot 22 to clasp a watch as is commonly understood in the art. The housing 12, the first clasp arm 18, and the second clasp arm 20 can be attached by a lock pin 24 and latch assembly 25, for example. The first clasp arm 18 and the second clasp arm 20 can be pivotally movable relative to one another and can include the lock pin 24 and latch assembly 25 that can retain the electronic clasp 10 in a closed position (FIGS. 3 and 4). Other mechanical, electronic and magnetic lock mechanisms are also contemplated.

It will be appreciated that the electronic clasp 10 can be coupled to an existing watch, such as an analog watch, a digital watch, or an analog/digital watch, in any suitable manner. The electronic clasp 10 can be a retrofit clasp that can be installed on an existing watch, or the electronic clasp 10 can be installed with a new watch to offer traditional styling with digital functionality. In one embodiment, the electronic clasp 10 can be designed for a specific high end watch model and can be an optional feature during purchase. In one embodiment, the electronic clasp can be a part of a kit that can be provided with a watch during purchase, where both a standard clasp and an electronic clasp can be provided. Versions of the electronic clasp can be configured for attachment to existing watches in any suitable manner such as, for example, with a mechanical linkage, magnetic connection, by a strap or line, by a hinged connection, or with any other suitable mechanism. In an alternate embodiment, the electronic clasp can be configured for universal applications, such as both an electronic clasp for a wristwatch as well as a pin, wearable, or the like. Electronic clasps can be watch model-specific or can be configured to couple or otherwise associate with a wide range of watch models.

The electronic clasp 10 can allow standard watches to compete more effectively in the emerging touchscreen watch market. Many consumers prefer the style of analog face watches to a digital watch face. These consumers may have a desire for the functionality of touchscreen watches, but do not want to give up a cherished watch or sacrifice the style of a high-end timepiece. The electronic clasp 10 can allow users or purchasers of high-end watches avoid choosing digital functionality over style. For example, the electronic clasp 10 can be an elegant steel watch clasp that can include a built in capacitive touchscreen that can have all of the capabilities of a touchscreen watch or smartphone, while remaining largely invisible to anyone but the watch owner. Depending on the preferences of the user or purchaser, the electronic clasp 10 can be designed to be highly visible, to blend in with the standard watch, or can include a cover (not shown) or other form of concealment.

Figure 2:
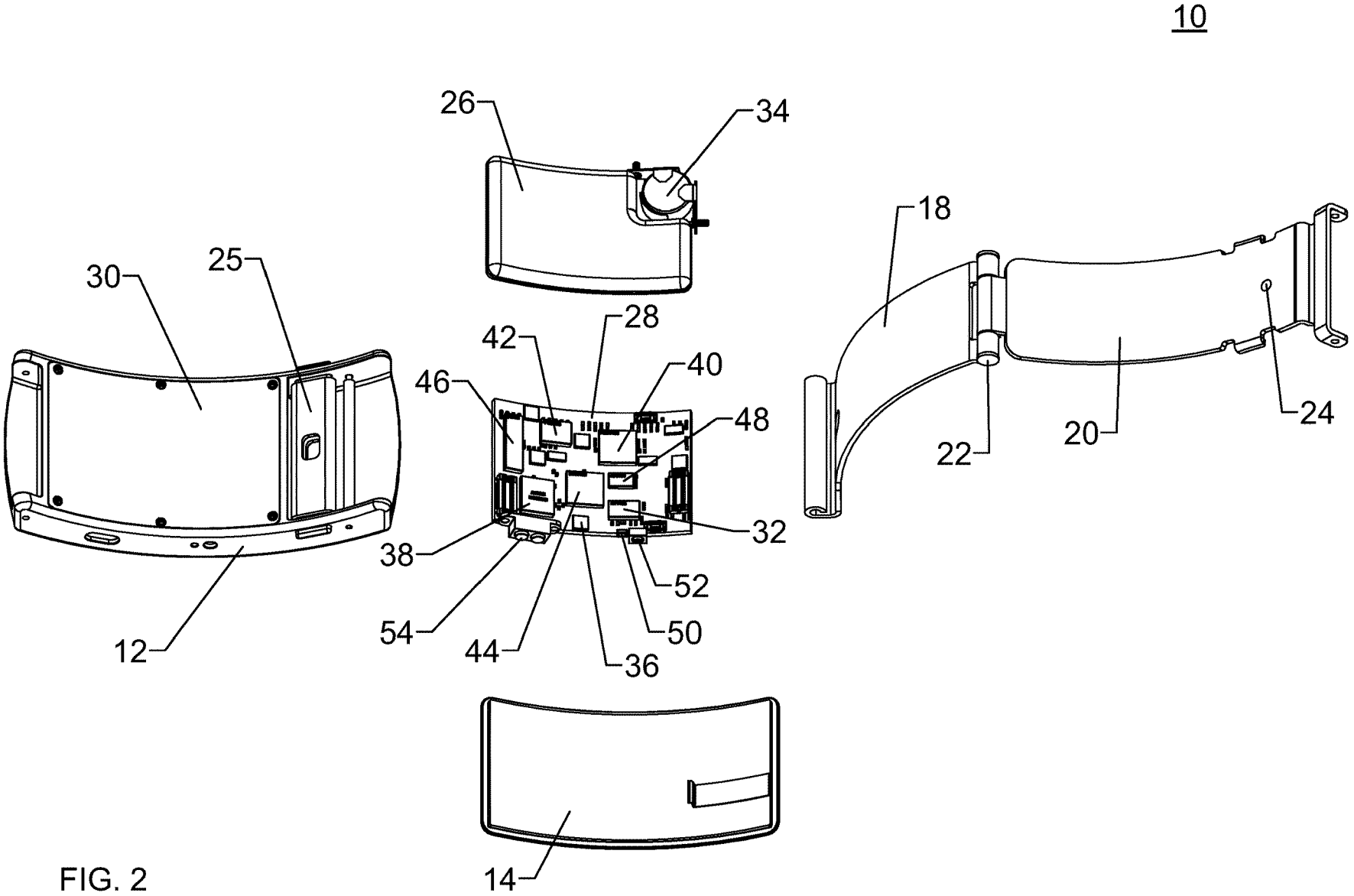
FIG. 2 depicts an exploded view of the electronic clasp shown in FIG. 1.

FIG. 2 illustrates an exploded view of the electronic clasp 10 shown in FIG. 1. The housing 12 can retain the display 14, a PCB housing base (not shown), a battery 26, a circuit board 28, and a PCB housing cover 30. The PCB housing base (not shown) and the PCB housing cover 30 can be configured to retain the battery 26 and circuit board 28. The circuit board 28 can include any suitable components such as, for example, a heart rate sensor 32, a vibration motor 34, a speaker 36, a central processing unit (CPU) 38 or controller, a WIFI or wireless receiver 40, a BLUETOOTH or short-wavelength personal area network receiver 42, a gyroscope 44, a GPS receiver 46, an accelerometer 48, a camera 50, a projector 52, and/or magnetic charging contacts 54. It will be appreciated that the components of the circuit board 28 can be coupled with the CPU 38 and the display 14 as is commonly known in the art.

The electronic clasp 10 can include a conventional power source or battery 26. The battery 26 can include a rechargeable secondary battery. Alternatively, the power source can include a solar battery, or any other suitable power source. The electronic clasp 10 can include any suitable component such as a camera, a barcode scanner, or a QR scanner (not shown). The housing 12 can include a selectively removable cover, sheath, slide, or the like that can conceal the display 14 or housing 12. The circuit board 28 can be associated with, and the housing can be configured to accept, a USB terminal (not shown).

Operationally, the electronic clasp 10 can be connected to a network unit that can include a wireless and/or Bluetooth communications transceiver unit or a NFC (Near Field Communication) unit. In general, the network unit can include a communication unit that can wirelessly communicate with a smart phone or other peripheral device. The network unit can also communicate with another electronic clasp, a smart watch, or the like. The network unit can utilize high frequency electromagnetic radiation, but it is also possible to use, for example, a line-of-sight mechanism such as infrared signals, or to use sonar or lower frequency radiation. In addition, in an alternative embodiment, a communications unit can include a unit for wirelessly accessing the Internet, or other communication network, and/or a satellite.

The display 14 can be a conventional liquid-crystal display (LCD), organic light-emitting diode (OLED), active-matrix organic light-emitting diode (AMOLED), passive matrix organic light emitting diode (PMOLED), or light emitting diode (LED) display and can include a touchpad or panel. Display 14 can be centrally located within the housing 12 and can be mounted on the opposite side of an analog or standard watch face. One or a plurality of accelerometers 48 or motion detection units can provide outputs such as arm movement information including distance, velocity, and acceleration. Display 14 can be rectangular in shape or have any other suitable configuration. In one embodiment, the housing 12 and display 14 can be configured to rotate relative to a traditional watch band where the user can, for example, rotate the rectangular housing 12 and display 14 90 degrees. An orientation sensor (not shown) can also be used to display the information in either a landscape format or a portrait format on the display 14. Such an orientation sensor can be linked to the position of the clasp or of the watch itself. The display 14 can also be comprised of a touchpad/screen layer. The display 14 can be configured such that a user can receive notifications from a phone, view caller ID from an associated smart phone, decline phone calls, view text messages, record conversations, or control a peripheral media player.

The circuit board 28 can include the CPU 38 that can be programmed and connected to deliver commands and receive information from the display 14 or the network unit. The circuit board 28 can include a memory unit (not shown). The electronic clasp 10 can permit a direct mechanical connection of the memory unit to, for example, a computer (not shown), or a charger (not shown), or through a converter cable (not shown) to a smart phone or the like. The electronic clasp 10 can also be coupled to an electrically connectable USB terminal that together with the memory unit can function as a conventional flash drive. The memory unit can store computer programs as well as certain data and information generated by the electronic clasp 10, or received by the electronic clasp 10, as an input. Such data can include biographic data about the user, information needed to couple with a computing device, social information, and task and calendar information. This information can be stored in the memory unit and can be generated in or forwarded by a computing device such as a smart phone. An example of information that can be generated in the electronic clasp 10 and stored in the memory unit can include motion information generated by the accelerometer 48. In one embodiment, the housing 12, display 14, and circuit board 28 can be configured as a dongle or the like and can be attached directly to a plurality of devices.

The electronic clasp 10 can include a plurality of notification lights (not shown) that can display certain statuses of a routine that the electronic clasp 10 is executing. For example, when the clasp 10 receives a NFC signal, one of the notification lights can blink to notify the user of the receipt of the NFC signal. The electronic clasp 10 can include an ON/OFF switch (not shown).

Figure 5:
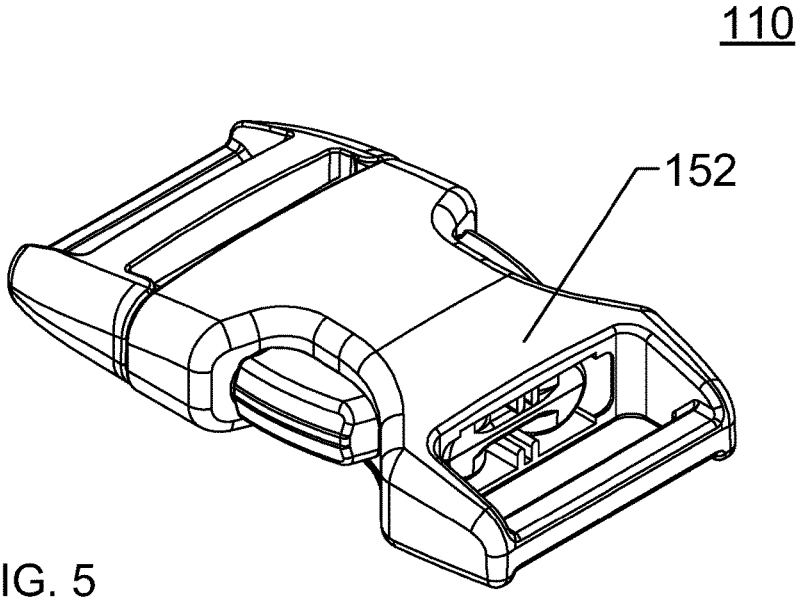
FIG. 5 depicts a top perspective view of a clasp having a mechanical linkage according to an alternate embodiment.
Figure 6:
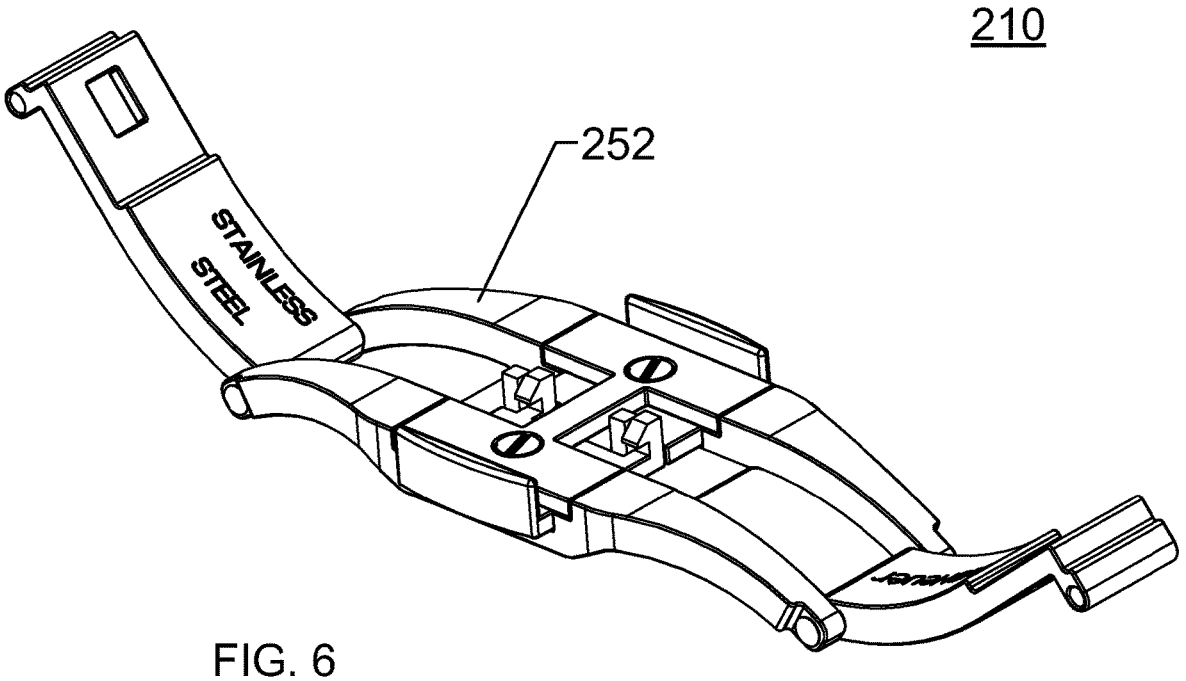
FIG. 6 depicts a bottom perspective view of a clasp having a mechanical linkage according to an alternate embodiment.

Referring to FIGS. 3 and 4, one embodiment of the electronic clasp 10 is shown associated with a standard wristwatch 50. As illustrated, the electronic clasp 10 can be mounted on the bottom of the wristwatch 50 in the same position as the original clasp. In an alternate embodiment, the electronic clasp can go over the top of an existing clasp on a watch or otherwise attach without requiring removal of any components. The electronic clasp 10 can be manufactured with the wristwatch 50, can be a retrofit to a wristwatch, and/or can be sold as a kit for a wristwatch with any other suitable linkages or attachments including a standard clasp. Referring to FIG. 5, an alternate embodiment of a clasp 110 is shown having a mechanical linkage 152. Referring to FIG. 6, an alternate embodiment of a clasp 210 is shown having a mechanical linkage 252. It will be appreciated that any suitable mechanical linkage for a clasp is contemplated. It will be appreciated that a housing or electronic interface can be associated with a plurality of different clasps and/or mechanical linkages.

In general, it will be apparent to one of ordinary skill in the art that at least some of the embodiments described herein can be implemented in many different embodiments of software, firmware, and/or hardware. The software and firmware code can be executed by a processor or any other similar computing device. The software code or specialized control hardware that can be used to implement embodiments is not limiting. For example, embodiments described herein can be implemented in computer software using any suitable computer software language type, using, for example, conventional or object-oriented techniques. Such software can be stored on any type of suitable computer-readable medium or media, such as, for example, a magnetic or optical storage medium. The operation and behavior of the embodiments can be described without specific reference to specific software code or specialized hardware components. The absence of such specific references is feasible, because it is clearly understood that artisans of ordinary skill would be able to design software and control hardware to implement the embodiments based on the present description with no more than reasonable effort and without undue experimentation.

Moreover, the processes described herein can be executed by programmable equipment, such as computers or computer systems and/or processors. Software that can cause programmable equipment to execute processes can be stored in any storage device, such as, for example, a computer system (nonvolatile) memory, an optical disk, magnetic tape, or magnetic disk. Furthermore, at least some of the processes can be programmed when the computer system is manufactured or stored on various types of computer-readable media.

It can also be appreciated that certain portions of the processes described herein can be performed using instructions stored on a computer-readable medium or media that direct a computer system to perform the process steps. A computer-readable medium can include, for example, memory devices such as diskettes, compact discs (CDs), digital versatile discs (DVDs), optical disk drives, or hard disk drives. A computer-readable medium can also include memory storage that is physical, virtual, permanent, temporary, semi-permanent, and/or semi-temporary.

A "computer," "computer system," "host," "server," or "processor" can be, for example and without limitation, a processor, microcomputer, minicomputer, server, mainframe, controller, microcontroller, laptop, personal data assistant (PDA), wireless e-mail device, cellular phone, pager, processor, fax machine, scanner, or any other programmable device configured to transmit and/or receive data over a network. Computer systems and computer-based devices disclosed herein can include memory for storing certain software modules used in obtaining, processing, and communicating information. It can be appreciated that such memory can be internal or external with respect to operation of the disclosed embodiments. The memory can also include any means for storing software, including a hard disk, an optical disk, floppy disk, ROM (read only memory), RAM (random access memory), PROM (programmable ROM), EEPROM (electrically erasable PROM) and/or other computer-readable media. Non-transitory computer-readable media, as used herein, comprises all computer-readable media except for a transitory, propagating signal.

In various embodiments disclosed herein, a single component can be replaced by multiple components and multiple components can be replaced by a single component to perform a given function or functions. Except where such substitution would not be operative, such substitution is within the intended scope of the embodiments.

Some of the figures can include a flow diagram. Although such figures can include a particular logic flow, it can be appreciated that the logic flow merely provides an exemplary implementation of the general functionality. Further, the logic flow does not necessarily have to be executed in the order presented unless otherwise indicated. In addition, the logic flow can be implemented by a hardware element, a software element executed by a computer, a firmware element embedded in hardware, or any combination thereof.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A digital clasp for a watch comprising:

a mechanical watch, the mechanical watch having a mechanical watch housing, and a mechanical watch face retained at least partially within the mechanical watch housing;

a clasp housing, the clasp housing having an inner surface, an outer surface, a first end, and a second end, the inner surface of the clasp housing being curved to accommodate the anterior surface of a user's wrist, wherein the clasp housing includes a butterfly clasp for attachment to a first end and a second end of an existing band coupled with the mechanical watch housing, wherein the clasp housing is positioned opposite the mechanical watch housing;

a digital display, wherein the digital display is at least partially retained by the clasp housing;

a circuit board associated with a controller, the circuit board and controller being coupled with the digital display, wherein the circuit board is at least partially retained by the clasp housing, and wherein the digital display, the circuit board and the controller are electronically and operatively independent from the mechanical watch;

the butterfly clasp including a first clasp arm, the first clasp arm having a first end and a second end, wherein the first end of the first clasp arm is coupled with the first end of the clasp housing such that the first clasp arm is configured to pivot relative to the clasp housing; and the butterfly clasp including a second clasp arm, the second clasp arm having a first end and a second end, wherein the first end of the second clasp arm is coupled with the second end of the clasp housing such that the second clasp arm is configured to pivot relative to the clasp housing.

2. The digital clasp of claim 1, further comprising a battery, wherein the battery is associated with the circuit board and is at least partially retained by the clasp housing and the battery is electronically and operatively independent from the mechanical watch.

3. The digital clasp of claim 1, wherein the circuit board is coupled with a heart rate sensor.

4. The digital clasp of claim 1, wherein the circuit board is coupled with a vibration motor.

5. The digital clasp of claim 1, wherein the circuit board is coupled with a speaker.

6. The digital clasp of claim 1, wherein the circuit board is coupled with a receiver.

7. The digital clasp of claim 1, wherein the circuit board is coupled with an accelerometer.

8. The digital clasp of claim 1, wherein the circuit board is coupled with a GPS receiver.

9. The digital clasp of claim 1, wherein the circuit board is coupled with a rechargeable power source.

10. The digital clasp of claim 1, further comprising a camera associated with the digital display, wherein the camera is electronically and operatively independent from the mechanical watch.

11. The digital clasp of claim 1, wherein the digital clasp includes a transmitter configured to communicate with a peripheral device.

12. The digital clasp of claim 1, wherein the digital display is selected from the group consisting of a liquid-crystal display, an organic light emitting diode, an active matrix organic light emitting diode, a passive matrix organic light emitting diode, a light emitting diode, and combinations thereof.

13. The digital clasp of claim 1, wherein the digital display is a touchscreen.

14. The digital clasp of claim 1, wherein the first clasp arm is configured for attachment to the first end of the existing hand and the second clasp arm is configured for attachment to the second end of the existing band, and the mechanical watch includes no electronic components.

15. A digital clasp for a watch comprising:

a mechanical watch, the mechanical watch having a mechanical watch housing, and a mechanical watch face retained at least partially within the mechanical watch housing;

a clasp housing, the clasp housing having an inner surface, an outer surface, a first end, and a second end, the inner surface of the clasp housing being curved to accommodate the anterior surface of a user's wrist, wherein the clasp housing includes a butterfly clasp for attachment to a first end of an existing band coupled with the mechanical watch housing, wherein clasp housing is positioned opposite the mechanical watch housing;

a touchscreen display, wherein the touchscreen display is at least partially retained by the clasp housing;

a circuit board associated with a controller, the circuit board and controller being coupled with the touchscreen display, wherein the circuit board is at least partially retained by the clasp housing and is coupled with a heart rate sensor, a vibration motor, a receiver, a GPS receiver, a speaker, an accelerometer, and a transmitter;

a rechargeable battery, the rechargeable battery coupled with the circuit board and the touchscreen display and at least partially retained by the clasp housing, and wherein the touchscreen display, the circuit board, the controller, and the rechargeable battery are electronically and operatively independent from the mechanical watch;

the butterfly clasp comprising a first clasp arm, the first clasp arm having a first end and a second end, wherein the first end of the first clasp arm is coupled with the first end of the clasp housing such that the first clasp arm pivots relative to the clasp housing;

the butterfly clasp comprising a second clasp arm, the second clasp arm having a first end and a second end; wherein the first end of the second clasp arm is coupled with the second end of the clasp housing such that the second clasp arm pivots relative to the clasp housing; and a first pivot, wherein the first pivot couples the first end of the first clasp arm to the first end of the clasp housing; and a second pivot, wherein the second pivot couples the first end of the second clasp arm to the second end of the clasp housing.

16. The digital clasp of claim 15, wherein the digital clasp is a retrofit kit for the existing band and wherein the mechanical watch includes no electronic components.

17. A watch comprising:

a mechanical watch, the mechanical watch having a mechanical watch housing, and a mechanical watch face retained at least partially within the mechanical watch housing;

a first watch band portion having a first end and a second end, wherein the first end of the first watch band portion is coupled with the mechanical watch housing;

a second watch band portion having a first end and a second end, wherein the first end of the second watch band portion is coupled with the mechanical watch housing;

a clasp housing, the clasp housing having an inner surface, an outer surface, a first end, and a second end; the inner surface of the clasp housing being curved to accommodate the anterior surface of a user's wrist, wherein the clasp housing includes a butterfly clasp for attachment to the second end of the first watch band portion and the second end of the second watch band portion, wherein the clasp housing is positioned opposite the mechanical watch housing;

the butterfly clasp including a first clasp arm, the first clasp arm having a first end and a second end, wherein the first end of the first clasp arm is coupled with the first end of the clasp housing such that the first clasp arm is configured to pivot relative to the clasp housing;

the butterfly clasp including a second clasp arm, the second clasp arm having a first end and a second end, wherein the first end of the second clasp arm is coupled with the second end of the clasp housing such that the second clasp arm is configured to pivot relative to the clasp housing, a digital display, wherein the digital display is at least partially retained by the clasp housing; and a circuit board associated with a controller, the circuit hoard and controller being coupled with the digital display, wherein the circuit board is at least partially retained by the clasp housing; and wherein the digital display, the circuit board, and the controller are electronically and operatively independent from the mechanical watch.

18. The watch of claim 17, wherein the second end of the first watch band portion is coupled with the second end of the first clasp arm and the second end of the second watch band portion is coupled with the second end of the second clasp arm, and wherein the mechanical watch includes no electronic components.

19. The watch of claim 17, wherein the clasp housing includes a transmitter configured to communicate with a peripheral device.

20. The watch of claim 17, the clasp housing further comprising a component feature selected from the group consisting of a battery, a heart rate sensor, a vibration motor, a speaker, a microphone, a receiver, an accelerometer, a GPS receiver, a rechargeable power source, a camera, and combinations thereof.

* * * * *